US009278555B2

(12) United States Patent
Toriihara et al.

(10) Patent No.: US 9,278,555 B2
(45) Date of Patent: Mar. 8, 2016

(54) PRINTING APPARATUS AND PRINTING METHOD

(71) Applicant: CANON KABUSHIKI KAISHA, Tokyo (JP)

(72) Inventors: Shigeru Toriihara, Kawasaki (JP); Masahito Yoshida, Shiki (JP); Masahiro Sugimoto, Yokohama (JP); Seiji Suzuki, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/250,660

(22) Filed: Apr. 11, 2014

(65) Prior Publication Data

US 2014/0307020 A1 Oct. 16, 2014

(30) Foreign Application Priority Data

Apr. 16, 2013 (JP) ..... 2013-085959

(51) Int. Cl.
*B41J 11/66* (2006.01)
*B41J 3/60* (2006.01)
*B41J 11/46* (2006.01)

(52) U.S. Cl.
CPC *B41J 11/663* (2013.01); *B41J 3/60* (2013.01); *B41J 11/46* (2013.01)

(58) Field of Classification Search
None
See application file for complete search history.

(56) References Cited

U.S. PATENT DOCUMENTS

2012/0194597 A1* 8/2012 Okamoto et al. ..... 347/16

FOREIGN PATENT DOCUMENTS

JP 2012-158122 A 8/2012

* cited by examiner

*Primary Examiner* — Justin Seo
(74) *Attorney, Agent, or Firm* — Fitzpatrick, Cella, Harper & Scinto

(57) ABSTRACT

In the case of performing duplex printing on a continuous sheet, by setting a length of a non-image area to an optimum length, both of mark detection having high reliability and the suppression of a sheet consumption amount are achieved. For this purpose, when duplex printing of a plurality of images on front and back surfaces of the continuous sheet is performed, on the basis of a length of the image to be printed precedently to a non-image area W3 on the second surface, the length of the non-image area common to the front and back surface is set.

7 Claims, 10 Drawing Sheets

CONVEYANCE DIRECTION 601
602
603
611
612
613
614
621
622
623
624
631
G3
G4
M
T

PRINTING APPARATUS AND PRINTING METHOD

BACKGROUND OF THE INVENTION

1. Field of the Invention

The present invention relates to a duplex printing apparatus and duplex printing method that print a plurality of images on each of front and back surfaces of a continuous sheet.

2. Description of the Related Art

There has been provided a printing apparatus that sequentially prints a plurality of images on a continuous sheet, and cuts the sheet on an image (page) basis. In such a printing apparatus, a conveyance state of the continuous sheet is influenced by an individual difference of the printing apparatus, the type or width of the sheet, use environment, or the like, and therefore a conveyance distance of the continuous sheet per unit time includes a certain level of error. For this reason, in order to prevent the continuous sheet from being cut in the middle of an image, a method that, between images, provides a non-image area printed with a cut mark indicating a cutting position, and on the basis of timing at which a detector detects the cut mark, cuts the continuous sheet with a cutter is used.

However, in the case where in order to detect such a cut mark, the detector performs a reading operation throughout the continuous sheet, a pattern in an image, which is similar to the cut mark, may also be determined as the cut mark to cut the continuous sheet on the middle of the image.

To address such a problem, Japanese Patent Laid-Open No. 2012-158122 discloses a method that performs a reading operation by a detector only on a non-image area printed with a cut mark. Also, Japanese Patent Laid-Open No. 2012-158122 discloses a configuration in which by focusing on the fact that an error in conveyance amount of a continuous sheet is increased along with an increase in conveyance distance of the continuous sheet, i.e., an increase in size of an image precedently printed, a size of a non-image area between two successive images is adjusted depending on a size of a precedent image. According to such a Japanese Patent Laid-Open No. 2012-158122, in a non-image area having a size enough to include a conveyance error of the continuous sheet, a cut mark can be detected, and therefore even in the case where a conveyance error occurs, the continuous sheet can be cut in a correct position.

However, with the configuration of Japanese Patent Laid-Open No. 2012-158122, a function of duplex printing that prints images on front and back surfaces of a continuous sheet may not be fulfilled. In the following, this is specifically described.

In general, even in the case of printing a plurality of images on front and back surfaces, a cutting position is common to the front and back surfaces. Accordingly, in such a printing apparatus, a layout of a plurality of images is determined such that one image to be printed on a front surface and one image to be printed on a back surface just on the back side of the front surface are coincident with each other to the utmost extent in terms of size and position in a conveyance direction. For this reason, one non-image area on a front surface and one non-image area on a back surface just on the backside of the front surface are also substantially coincident with each other in terms of size.

On the other hand, in such a duplex printing apparatus, it is typical to place a reversing roller downstream of a printing unit that prints an image, reverse here a continuous sheet in terms of front and back surface, which has been subjected to front surface printing, and then send the continuous sheet to the printing unit again. In doing so, the continuous sheet sent from the reversing roller is reversed in terms of the front and back surfaces thereof, as well as in terms of fore and rear ends thereof in a conveyance direction. That is, a part serving as a rearmost end at the time of printing the front surface serves as a foremost end at the time of printing the back surface. As in Japanese Patent Laid-Open No. 2012-158122, in the case of adjusting a size of an individual non-image area depending on a size of a precedent image at the time of printing a front surface, a size of a non-image area at the time of printing a back surface is adjusted depending not on a size of a precedent image but on a size of a subsequent image.

FIG. 10 is a schematic diagram for specifically describing such a situation. For example, consider the case where on a front surface, an image A, image B, and image C are sequentially printed, and on back surfaces of the images A, B, and C, images D, E, and F respectively having the same sizes as those of the images A, B, and C are printed. In this case, according to Japanese Patent Laid-Open No. 2012-158122, at the time of surface printing that prints the images while conveying a continuous sheet in an A-direction, a size WA of a non-image area 1 between the images A and B is set depending on a size LA of the image A. Also, a size WB of a non-image area 2 between the images B and C is set depending on the size LB of the image B, and a size WC of a non-image area 3 subsequent to the image C is set depending on the size LC of the image C.

On the other hand, at the time of back surface printing, the continuous sheet is reversed in terms of fore and rear ends thereof, and therefore the conveyance direction is switched to a B direction. Accordingly, the images F, E, and D are printed in this order so as to respectively coincide in position with the images C, B, and A. As a result, on a back surface side, the continuous sheet is conveyed and printed in the order of non-image area 3→image F→non-image area 2→image E→non-image area 1→image D, and detection of cut marks and cutting are also performed in this state.

According to an original purpose of Japanese Patent Laid-Open No. 2012-158122, an error in conveyance amount of a continuous sheet is increased/decreased depending on a size of an image precedently conveyed, and therefore the size of the non-image area 1 at the time of a cutting operation should be adjusted depending on the size of the image E to be conveyed precedently to the non-image area 1. However, in the case of duplex printing employing a technique in Japanese Patent Laid-Open No. 2012-158122 as described above, at the time of the back surface printing where a cutting process is actually performed, the size of the non-image area 1 is adjusted depending not on the size of the image E to be precedently conveyed but on the size of the image A having substantially the same size as that of the image D to be subsequently conveyed. That is, a non-image area appropriate to an error in conveyance amount is not provided, and a problem to be solved by Japanese Patent Laid-Open No. 2012-158122 cannot be solved.

SUMMARY OF THE INVENTION

The present invention is made in order to solve the above-described problem, and an object thereof is to, in the case of performing duplex printing on a continuous sheet, set a length of a non-image area to an optimum length to thereby achieve both of mark detection having high reliability and the suppression of a sheet consumption amount.

In a first aspect of the present invention, there is provided a printing method for performing duplex printing on a first surface and a second surface of a continuous sheet, comprising: providing, for printing a plurality of images on the first surface and then the second surface, a non-image area between adjacent images on each of the first surface and the second surface; forming a mark for cutting the sheet in the non-image area provided on the second surface; and setting the length of the non-image area in a direction in which the sheet is conveyed on the first surface and the second surface, depending on a length of an image printed precedently to the non-image area provided on the second surface.

In a second aspect of the present invention, there is provided a printing apparatus comprising: a printing unit configured to perform duplex printing on a first surface and a second surface of a continuous sheet under conveyance; a detecting unit configured to detect a mark formed on the sheet; and a cutter unit configured to cut the sheet, wherein the printing apparatus, for printing a plurality of images on the first surface and then on the second surface in the printing unit, a non-image area between adjacent images is provided on each of the first surface and the second surface, and a mark to be detected in the detecting unit in order to cut the sheet in the cutter unit is formed in the non-image area provided on the second surface; and the length of the non-image area is set such that, in a direction in which the sheet is conveyed, as a length of an image printed precedently to the non-image area provided on the second surface increases, the length of the non-image area increases.

Further features of the present invention will become apparent from the following description of exemplary embodiments (with reference to the attached drawings).

DESCRIPTION OF THE EMBODIMENTS

Figure 1:
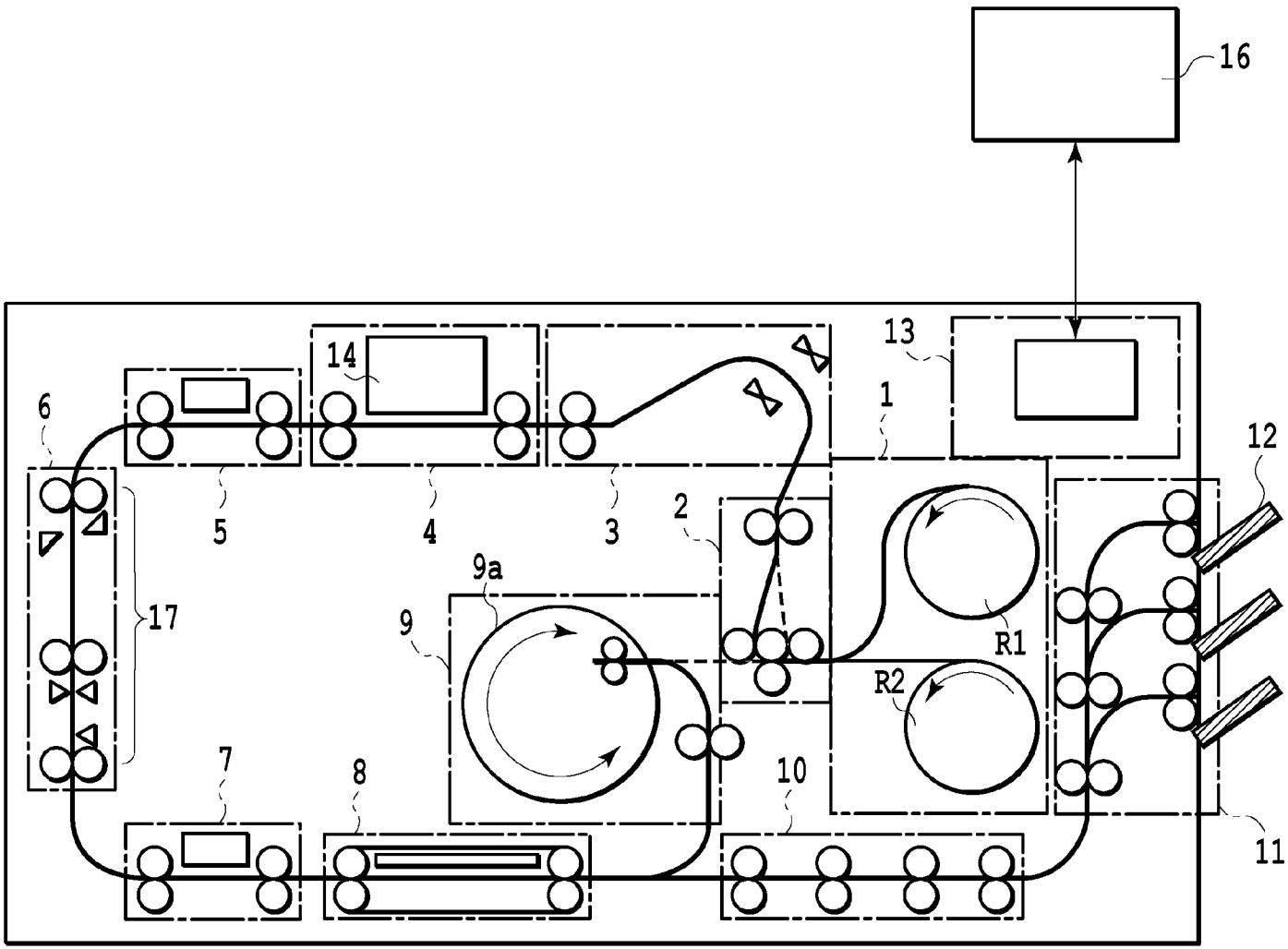
FIG. 1 is a cross-sectional view of a duplex printing apparatus usable in the present invention.

FIG. 1 is a cross-sectional view of a duplex printing apparatus usable in the present invention. A sheet feeding unit 1 contains two rolls R1 and R2, and alternatively draws a sheet to feed the sheet to a conveyance path. Note that the number of containable rolls is not limited to two, but may be one, or three or more.

A decurling unit 2 is a unit that reduce a degree of a curl (curve) of a sheet fed from the sheet feeding unit 1 or an after-mentioned reversing unit 9. In the decurling unit 2, two pinch rollers are pressed against one driving roller to give the sheet a curve having a direction opposite to a direction of the curl. The sheet passes through the decurling unit 2, whereby the degree of the curl given by the sheet feeding unit 1 or the reversing unit 9 is reduced, and the sheet is smoothly conveyed.

A skewing correcting unit 3 is a unit that corrects skewing (an inclination of the sheet with respect to a traveling direction) of the sheet having passed through the decurling unit 2. By pressing a sheet end part on a side serving as a reference against a guide member, the sheet is directed so as to travel straight.

A mark reader 18 is a unit that, at the time of performing duplex printing, optically reads a reference mark on a first surface having been already printed with an image. The mark reader 18 has; a light source (e.g., a white LED) that illuminates the sheet surface; and a light receiver that detects light from the illuminated sheet surface on an RGB component basis, such as a photodiode or an image sensor. In the case of performing duplex printing, in an after-mentioned printing unit 4, a printing position of an image on a second surface is adjusted according to the reference mark on the first surface, which has been read by the mark reader 18.

In the printing unit 4, ink is ejected from a print head 14 onto a sheet under conveyance to print an image. The print head 14 also prints, in addition to image data, a cut mark indicating a position to cut the sheet, the above-described reference mark, a test pattern for checking a print state of the print head, or the like. The printing unit 4 is provided with a plurality of conveyance rollers for conveying the sheet, a platen that supports the sheet from below, and the like, and supports the sheet so as to smooth an area of the sheet, which faces to the print head 14.

The print head 14 of the present embodiment includes an inkjet type line head in which a plurality of nozzles ejecting ink are arrayed in a direction intersecting with a sheet conveyance direction within a range covering a maximum width of a sheet supposed to be used. Further, a plurality of such line heads are parallel arranged in the conveyance direction up to the number corresponding to the number of ink colors. In the present embodiment, it is assumed that seven line heads corresponding to seven colors of C (cyan), M (magenta), Y (yellow), LC (light cyan), LM (light magenta), G (gray), and K (black) are provided. Inks of the respective colors are supplied to the print head 14 through ink tubes from unillustrated ink tanks.

An inspecting unit 5 is a unit that is provided with a CCD image sensor or a CMOS image sensor, and optically reads an inspection pattern or image on a sheet printed in the printing unit 4. Information having been read is transferred to a control unit 13, where nozzle states of the print head 14, a sheet conveyance state, a position of an image, and the like are assessed.

A cutter unit 6 is provided with: an edge sensor 603 for detecting a sheet fore end; and cut mark sensors 601 and 602 serving as detecting parts that detect a cut mark on a sheet. The cutter unit 6 is further provided with cutters 611 to 614 that cut the sheet on the basis of a position of the cut mark detected by the sensors, or timing. The cutters 611 to 614 are arranged with being separated on upstream and downstream sides, and according to the cut mark printed on the sheet, respectively cut fore and rear end sides of an image. A cut sheet after the cutting, i.e., an image sheet (page) is conveyed to the next step by a plurality of rollers. On the other hand, a non-image sheet between images is contained in a trash box 17. As described, the cutter unit 6 is provided with a mechanism for classifying a conveyance path between an image sheet and a non-image sheet after cutting. Note that in the case of performing duplex printing, the cutter unit 6 only cuts a rear end part of a last image on a first surface, and a continuous sheet is conveyed to an information printing unit 7 without being cut. Cutting control in the cutter unit 6 will be described later in detail.

The information printing unit 7 prints pieces of information on a serial number, date, and the like related to a printed image as characters and codes in a margin area of an image sheet.

A drying unit 8 is a unit for drying given ink for a short period of time, and dries the ink by applying hot air to a passing image sheet from a rear surface that is on a side opposite to a printed surface. A drying method is not limited to the hot air method, but may be a method that irradiates a sheet surface with an electromagnetic wave (such as ultraviolet or infrared light).

In the present embodiment, a path from the above-described sheet feeding unit 1 to drying unit 8 is referred to as a first path. The first path is of a U-turn shape from the printing unit 4 to the drying unit 8, and the cutter unit 6 is located approximately in the middle of the U-turn shape. The first path is a path through which, regardless whether printing is duplex printing or simplex printing, a sheet passes in common. A continuous sheet having been subjected to first surface printing of the duplex printing is, after the first path, conveyed to a second path provided with the reversing unit 9. On the other hand, a cut sheet having been subjected to second surface printing of the duplex printing, or a cut sheet having been subjected to the simplex printing is, after the first path, conveyed to a third path provided with a discharging/conveying unit 10.

The reversing unit 9 is a unit that, in the case of performing duplex printing, temporarily rewinds a continuous sheet having been subjected to first surface printing. The continuous sheet having been subjected to the first surfaced printing is gradually rewound by a reversing roller (drum) 9*a* that rotates anticlockwise. The reversing roller 9*a* stops when having rewound the continuous sheet to a rear end part of the sheet, and then rotates in an opposite direction, i.e., clockwise. This causes the continuous sheet to be sent to the decurling unit 2. The decurling unit 2 corrects the sheet so as to reduce a degree of a curve provided at the time of the rewinding by the reversing roller 9*a*.

In a path from the decurling unit 2 toward the printing unit 4, the continuous sheet is in a state of being reversed in terms of front and back surfaces and fore and rear ends thereof. That is, the continuous sheet is conveyed with a second surface facing to the print head 14 and the rear end part at the time of the first surface printing serving as the fore end part. A path through which the sheet sent from the drying unit 8 is reversed in terms of the front and back surfaces thereof and then sent into the decurling unit 2 as described is referred to as the second path.

The discharging/conveying unit 10 conveys a cut sheet, which was cut in the cutter unit 6 and dried in the drying unit 8, to a sorter unit 11. The sorter unit 11 sorts printed cut sheets on a group basis, such as a size basis, and discharges the cut sheets to corresponding discharge ports. For each of the discharge ports, a tray 12 for receiving cut sheets is prepared, and a cut sheet is placed on any of the trays 12. A path through which a sheet sent from the drying unit 8 is discharged to any of the trays 12 as described is referred to as the third path. Although not illustrated in FIG. 1, at a position that is located downstream of the drying unit 8 and serves as a branching position between the paths, a movable flapper for selectively guiding a sheet to any of the second and third paths is provided.

The control unit 13 is a unit that controls the whole of the printing apparatus. Operation of the whole of the printing apparatus is controlled on the basis of a command from the control unit 13 or a host device 16 connected to the outside.

Figure 2:
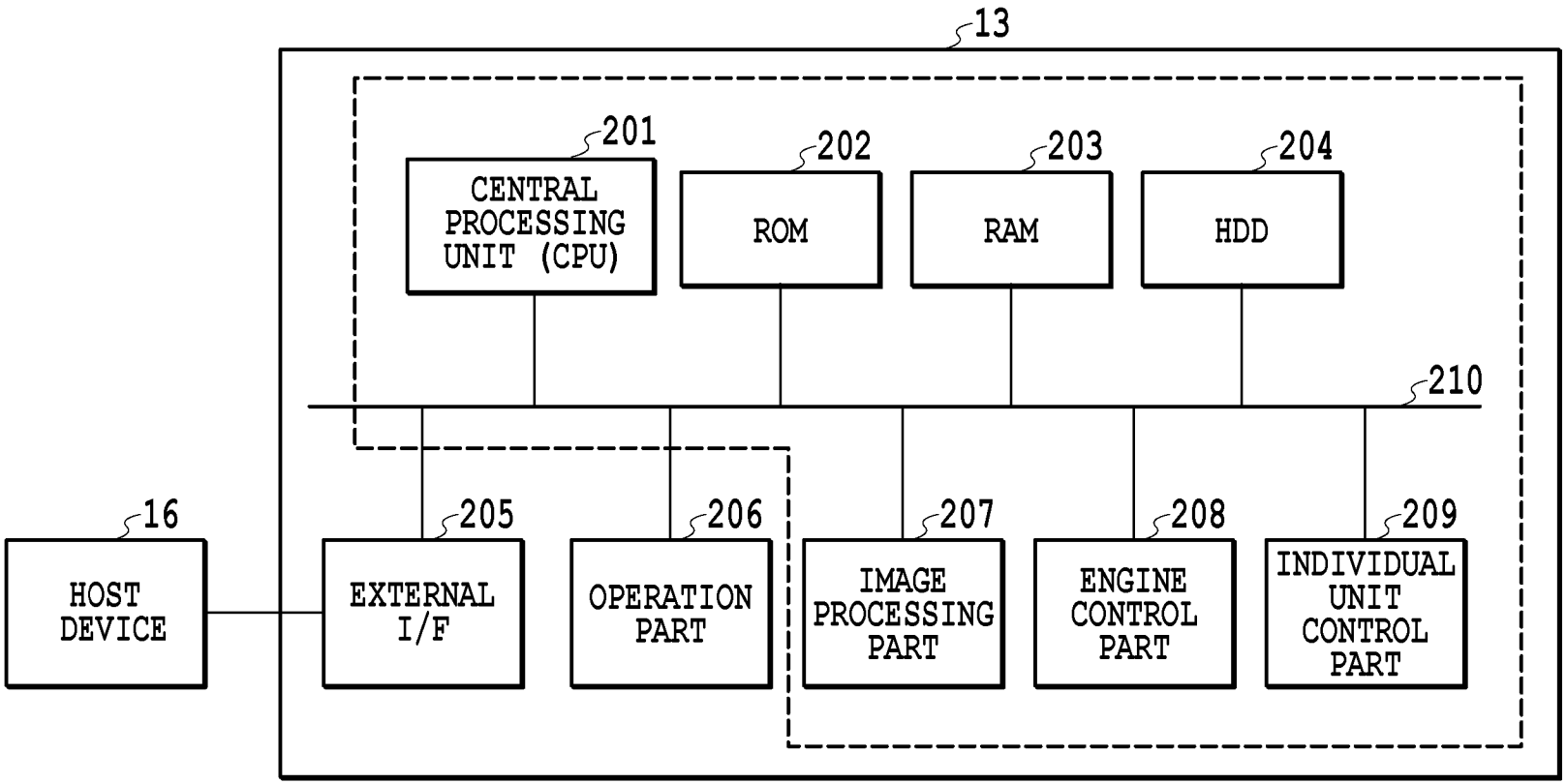
FIG. 2 is a block diagram for describing a configuration of control in a control unit.

FIG. 2 is a block diagram for describing a configuration of the control in the control unit 13. An area surrounded by a dashed line corresponds to a controller, which is configured to include a CPU 201, ROM 202, RAM 203, HDD 204, image processing part 207, engine control part 208, and individual unit control part 209. The CPU 201 (central processing unit) integrally controls operations of the respective units as described above, and according to image data received from the host device 16 connected to the outside, performs a print operation.

The ROM 202 stores a program to be executed by the CPU 201, and pieces of fixed data necessary for various types of operations. The RAM 203 is used as a work area for the CPU 201, or used as a temporary storage area for various pieces of received data. The HDD 204 (hard disk) stores a program to be executed by the CPU 201, image data, and pieces of setting information necessary for various types of operations of the printing apparatus, from which the CPU 201 reads various pieces of data to perform various types of control.

The image processing part 207 converts image data received from a host device 16 to image data that is printable by the printing apparatus. Specifically, in the case where color space of input image data is YCbCr or sRGB space, the image processing part 207 refers to a conversion table and coefficients stored in the ROM 202, and converts the image data to image data corresponding to printable colors and print resolution. The processed image data is temporarily stored in the RAM 203 or the HDD 204.

The engine control part 208 performs driving control of the print head 14 according to image data stored in the RAM 203 or the HDD 204. The individual unit controller 209 is a sub-controller placed for the respective units such as the sheet feeding unit 1 and the decurling unit 2. At the time of printing, some control is completed within the sub-controller, and therefore a load on the CPU 201 is reduced.

An operation part 206 is an input/output interface with a user, and provided with: input parts such as hard keys and a touch panel; and output part such as a display and sound generator for presenting pieces of information.

An external interface 205 is an interface intervening between the host device 16 and the control unit 13 of the printing apparatus. The external interface 205 may be a local interface or a network interface.

The host device 16 may be a general-purpose or dedicated computer, and in addition, may be a device such as an image capture having an image reader part, a digital camera, or a photo-storage. In the case where the host device 16 is a computer, an OS, application software for generating image data, a printer driver for the printing apparatus are installed in a storage device included in the computer. In addition, all of the above-described processing steps are not required to be performed by software, and part or all of them may be performed by hardware.

Figure 3:
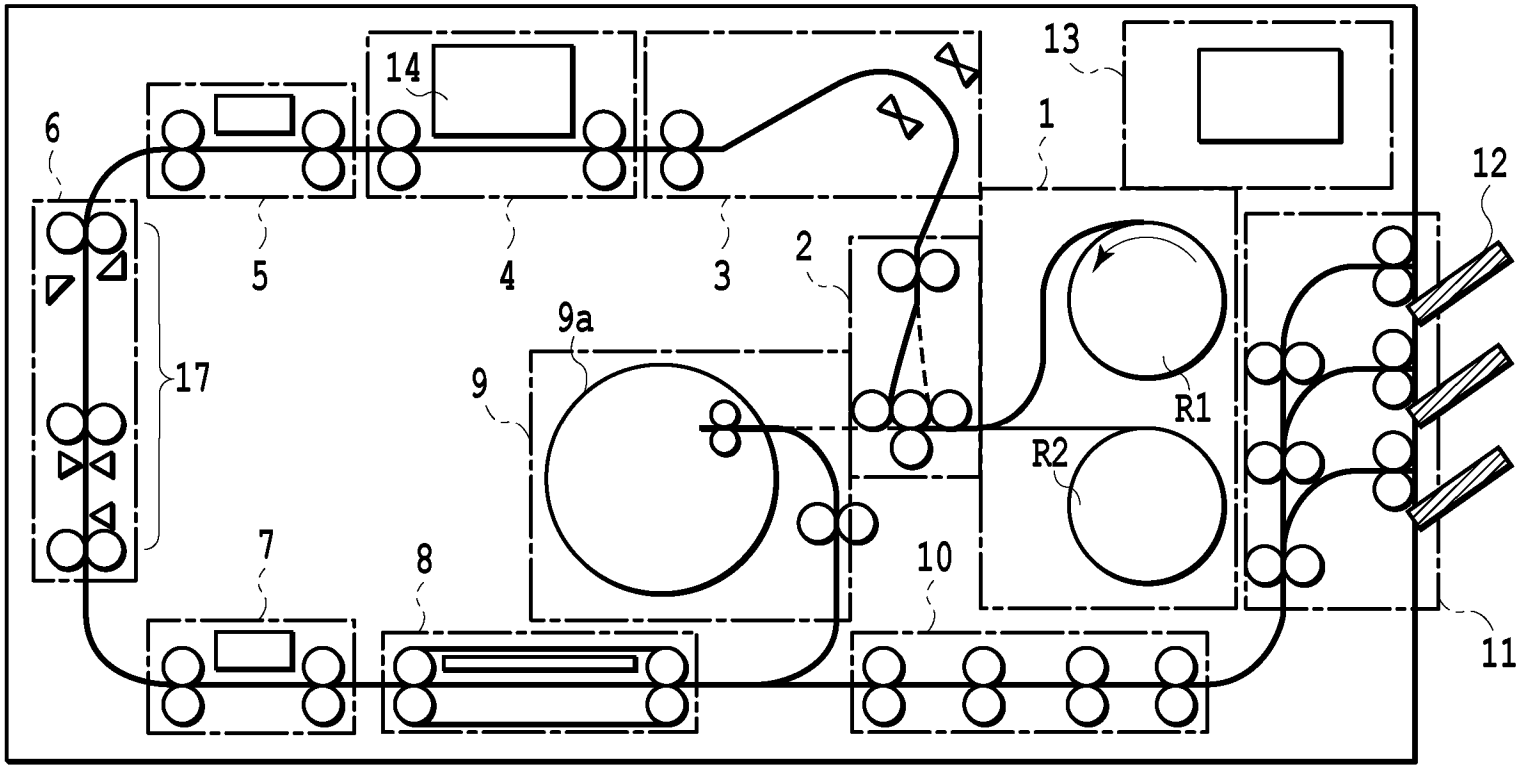
FIG. 3 is a diagram for describing operation in simplex printing in detail.
Figure 4:
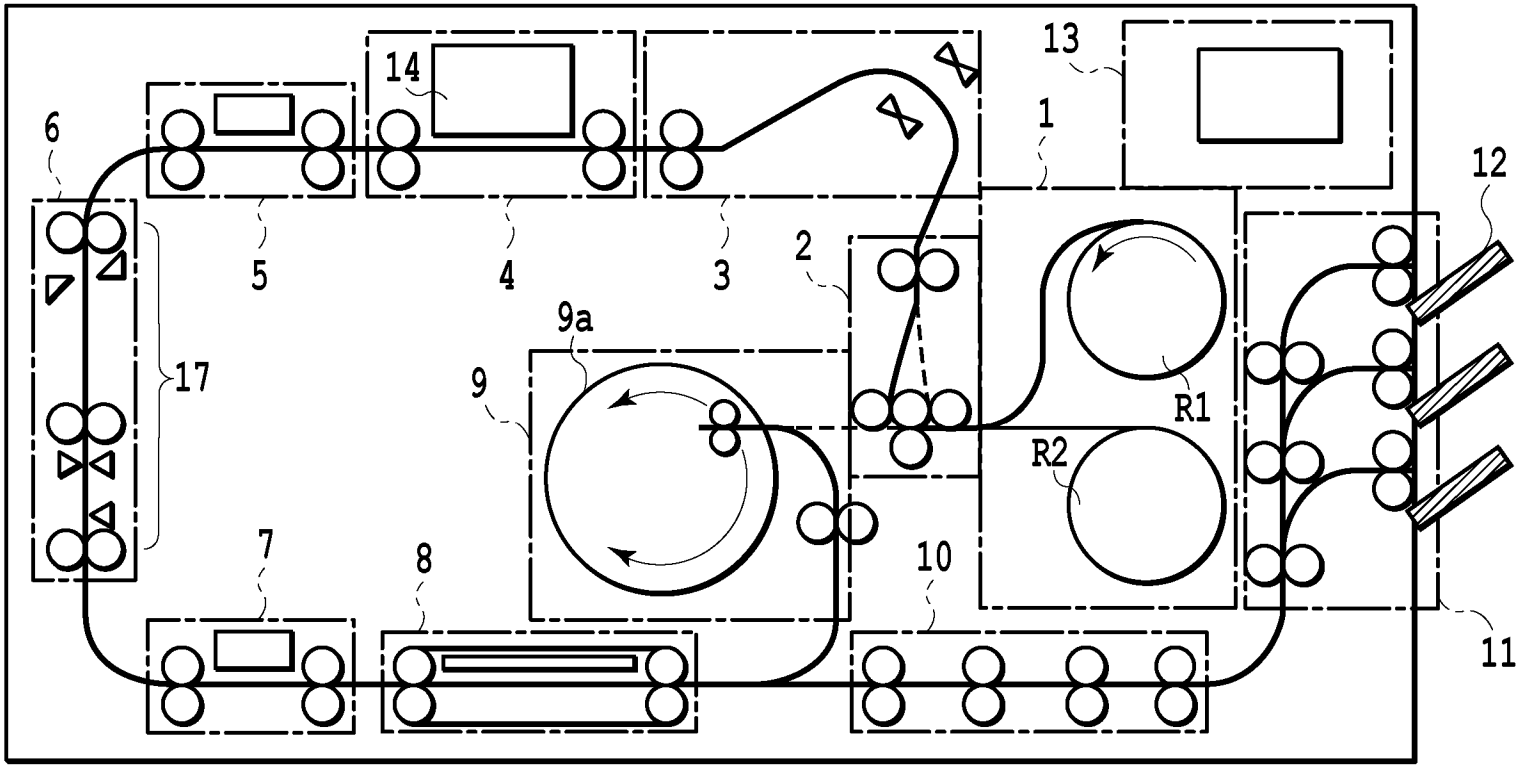
FIG. 4 is a diagram for describing operation in duplex printing in detail.

FIGS. 3 and 4 are diagrams for described respective operations of simplex printing and duplex printing in detail. In both of the diagrams, continuous sheets or cut sheets are indicated by solid lines in conveyance paths, respectively.

Referring to FIG. 3, in the case of the simplex printing, a continuous sheet fed from the sheet feeding unit 1 passes through the decurling unit 2 and the skewing correcting unit 3, and in the printing unit 4, is printed with a plurality of images (pages) according to pieces of image data. At this time, between images, i.e., between respective pages, a non-image area having a size depending on a length of a precedent image just before the non-image area is provided according to Japanese Patent Laid-Open No. 2012-158122, and in the non-image area, a cut mark is printed. The printed sheet is cut on a page bases by cutters arrayed in the cutter unit 6, and the non-image area is contained in the trash box 17. On the other hand, although drawn from the sheet feeding unit, an area not printed in the printing unit 4 is again rewound by the roll R1 or R2 of the sheet feeding unit 1 after cutting for a last page has been completed.

A cut sheet after the cutting is, on a back surface thereof, printed with print information in the information printing unit 7 as necessary, and after having been dried in the drying unit 8, placed on a predetermined discharge tray through the discharging/conveying unit 10 and sorter unit 11. As described, in the case of the simplex printing, the sheet is conveyed through the first and third paths, and thereby sequentially subjected to printing, cutting, and discharging operations without delay.

On the other hand, referring to FIG. 4, in the case of the duplex printing, a continuous sheet fed from the sheet feeding unit 1 passes through the decurling unit 2 and the skewing correcting unit 3, and in the printing unit 4, first, on a first surface (front surface) thereof, printed with a plurality of images (pages) according to pieces of image data. At this time, between images, i.e., between respective pages, a non-image area having a predetermined size is provided. A length of the non-image area in the duplex printing will be described later in detail.

The printed sheet passes through the cutter unit 6. Note that the page-basis cutting is not performed, and only a rear end part of a last page is cut by the cutter unit 6. At this time, although drawn from the sheet feeding unit, an area not printed is again rewound by the roll R1 or R2 of the sheet feeding unit 1.

On the other hand, a fore end of the continuous sheet is dried in the drying unit 8, and then travels toward the reversing unit 9 in the second path. In the reversing unit 9, the reversing roller (drum) 9*a* rotates anticlockwise in the diagram, and rewinds the continuous sheet having been subjected to the first surface printing. The reversing roller (drum) 9*a* once stops when having rewound the continuous sheet to a rear end of the continuous sheet, and after it has been checked that the sheet located downstream of a cutting position has been sent back and contained again in the sheet feeding unit 1, starts to rotate clockwise. This causes the continuous sheet to be conveyed to the decurling unit 2 with a rear end part of the continuous sheet serving as a fore end part.

In the decurling unit 2 and subsequent units, the continuous sheet is again conveyed through the first path with being reversed in terms of the front and back surfaces and fore and rear ends thereof. In the printing unit 4, in accordance with reference marks on the first surface, which have been read by the mark reader 18, images according to pieces of image data are printed on the second surface. At this time, in a non-image area between images, a cut mark is also printed. The printed sheet is cut on a page basis by the cutters arrayed in the cutter unit 6, and the non-image area is contained in the trash box 17. A cut sheet after the cutting is dried in the drying unit and then placed on a predetermined tray through the discharging/conveying unit 10 and sorter unit 11.

As described, in the case of the duplex printing, the sheet is conveyed in the order of first path→second path→first path→third path, and thereby the first surface (front surface) printing, sheet reversal, second surface (back surface) printing, cutting, and discharging are performed in this order.

Figure 5:
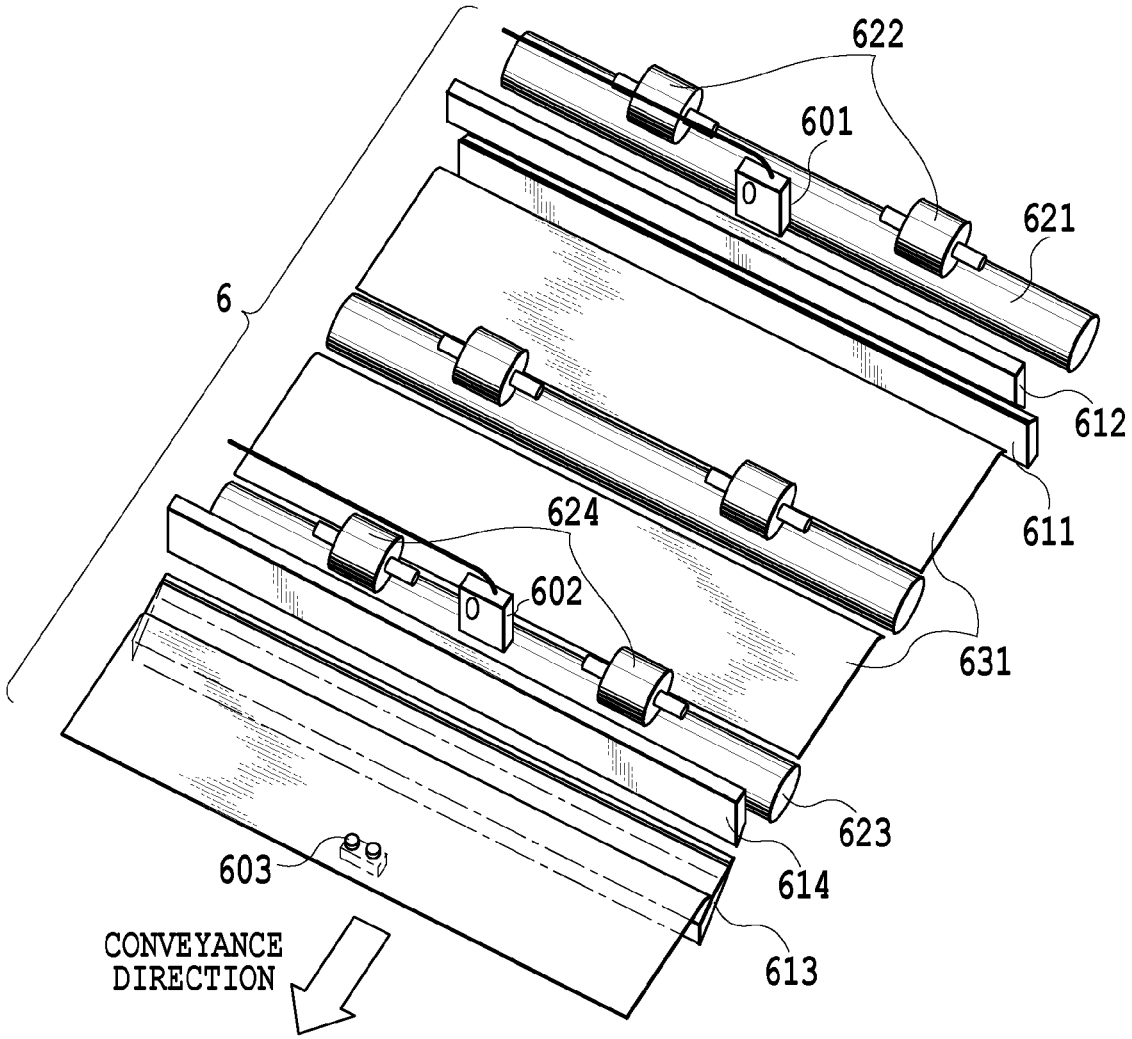
FIG. 5 is a perspective view for describing a configuration of a cutter unit in detail.
Figure 6:
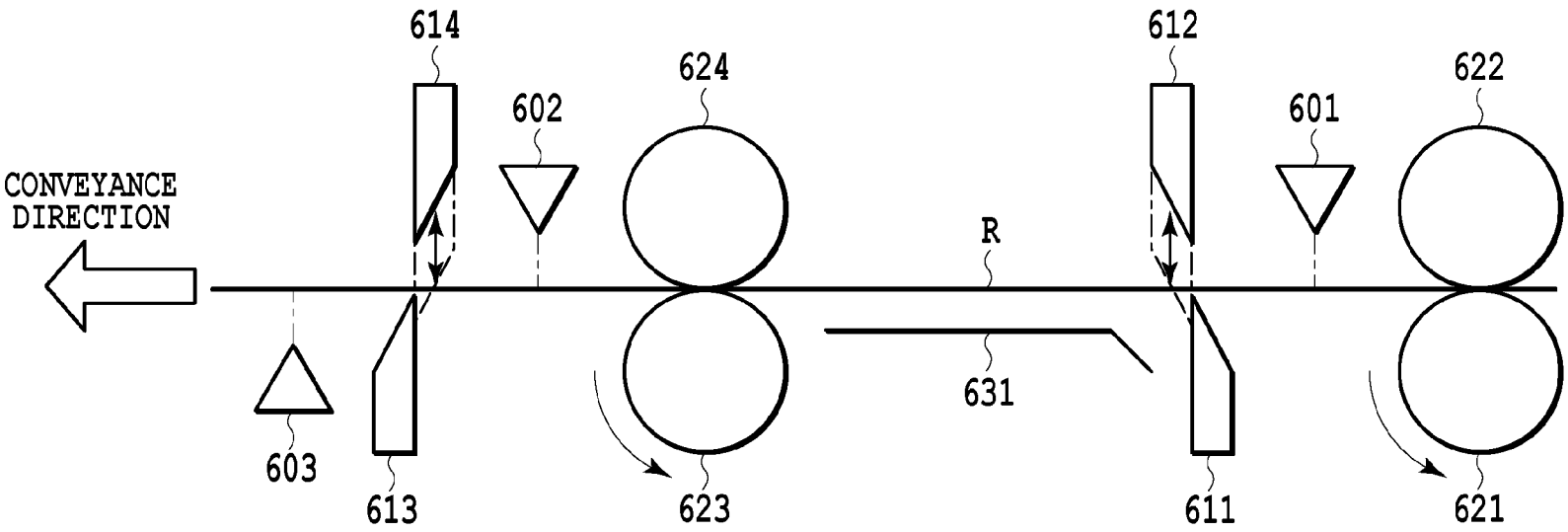
FIG. 6 is a side view for describing the configuration of the cutter unit in detail.

FIGS. 5 and 6 are perspective and side views for describing a configuration of the cutter unit 6 in detail. In the cutter unit 6, at an upstream side inlet in the conveyance direction, a first conveyance roller 621 and first pinch rollers 622 are arranged, whereas at a downstream side outlet in the conveyance direction, a second conveyance roller 623 and second pinch rollers 624 are arranged, and the rollers convey a sheet in the cutter unit 6 with sandwiching the sheet from front and back surfaces. Between the two roller pairs, guide plates 631 are disposed, and to keep the sheet under conveyance smooth, support the sheet from below. Further, the edge sensor 603 is disposed most downstream of the cutter unit 6, and thereby adapted to be able to detect foremost and rearmost ends of a sheet.

Immediately downstream of the first conveyance roller 621 and second conveyance roller 623, the first cut mark sensor 601 and the second cut mark sensor 602 are respectively arranged to detect a cut mark printed on the sheet under conveyance. Further, on the basis of timing at which the cut mark sensor 601 detects the cut mark, the first movable cutter 612 moves down toward the first fixed cutter 611 side to cut the sheet. This causes a fore end of an image area to be separated from a precedent non-image area. Also, on the basis of timing at which the cut mark sensor 602 detects the cut mark, the second movable cutter 614 moves down toward the second fixed cutter 613 side to cut the sheet. This causes a rear end of the image area to be separated from a subsequent non-image area. That is, the two-step cutting by the two sets of cutters separates the image areas printed with images according to pieces of image data and the non-image area printed with the cut mark from each other. After that, the image areas are conveyed as cut sheets to the information printing unit 7, whereas the non-image sheet is contained in the trash box 17. In addition, during the above cutting, conveyance of the sheet is temporarily interrupted.

FIGS. 7A to 7H are side views for describing the cutting operation in the cutter unit 6 with time. Here, the side views illustrate conveyance states of a continuous sheet that is printed with an image G3 and an image G4 in this order.

Figures 7A, 7B, 7C, 7D, 7E, 7F, 7G, 7H:
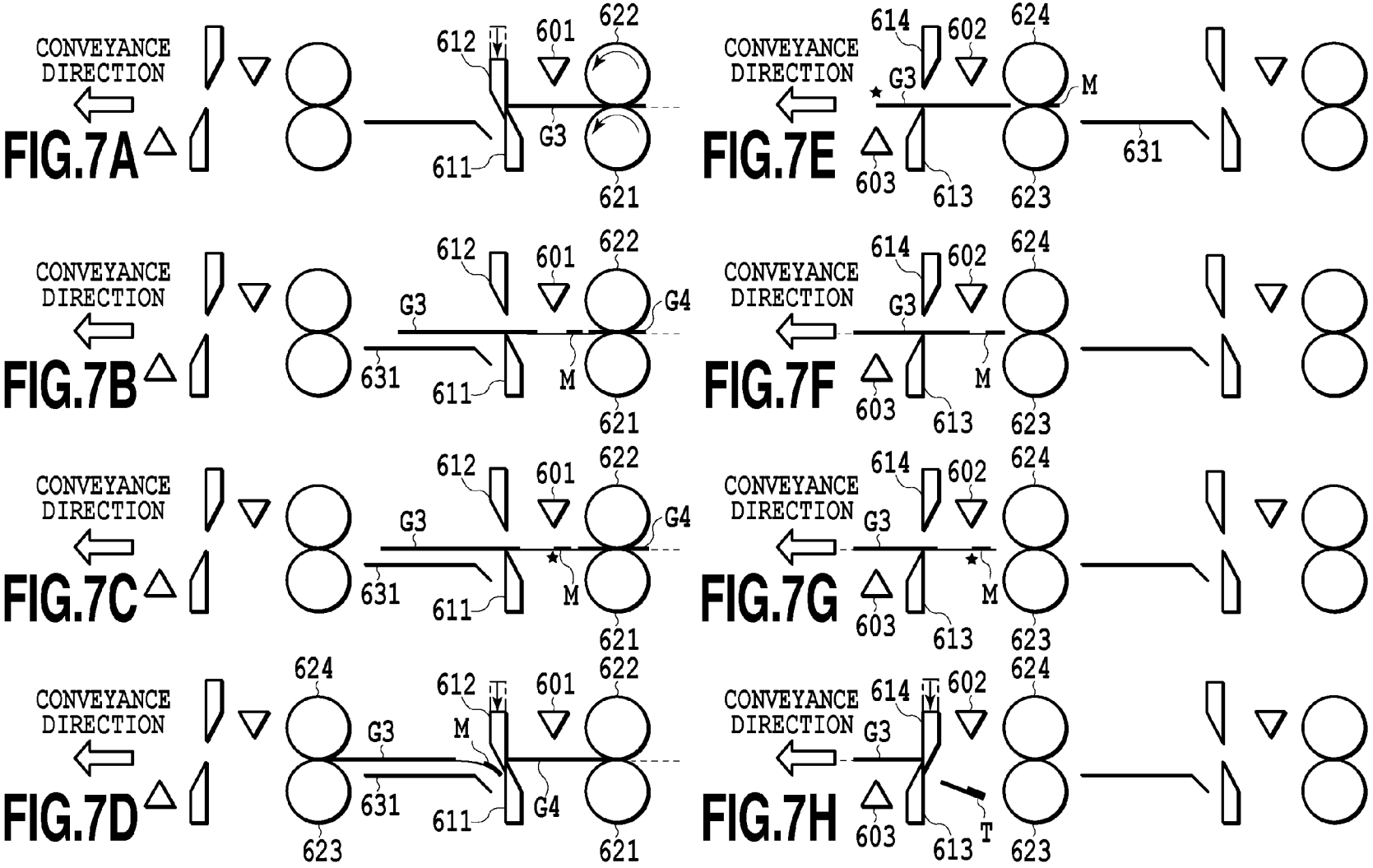
FIGS. 7A to 7H are side views for describing a cutting operation in the cutter unit with time.

FIG. 7A illustrates the state where a fore end of the image G3 is cut by the first fixed cutter 611 and first movable cutter 612 from a non-image area located upstream of the image G3. After such cutting has been performed, the control unit 13 starts to count a conveyance amount before starting a detecting operation by the first cut mark sensor 601. The detecting operation is one that is intended to detect a cut mark located downstream of the image G3; however, in case of performing the detecting operation on the image G3, a pattern that is present in the image G3 and similar to the cut mark may be erroneously detected as the cut mark. Accordingly, in order to perform the detecting operation only within a non-image area printed with the cut mark, from a length of the image G3, the control unit 13 estimates a conveyance distance from the cutting of the fore end of the image G3 to the start of the detecting operation, and continues the counting until the conveyance amount reaches the conveyance distance.

FIG. 7B illustrates the conveyance state at timing when the first cut mark sensor 601 starts the detecting operation. The detecting operation by the cut mark sensor 601 is started when a non-image area W3 is located below the cut mark sensor.

FIG. 7C illustrates the conveyance state at timing when the first cut mark sensor 601 detects a cut mark in the non-image area W3 after the conveyance operation has proceeded. A configuration of the cut mark is not particularly limited, and for example, by printing a solid black pattern in a white non-image area, the presence of the pattern can be detected on the basis of a sudden change in reflected light.

FIG. 7D illustrates a situation where the first movable cutter 612 moves down toward the first fixed cutter 611 to cut the sheet at the boundary between the non-image area W3 and the image G4. Such a cutting operation is performed on the basis of the timing at which the cut mark sensor 601 detects the cut mark in FIG. 7C. At the moment of the cutting operation, the conveyance operation is temporarily stopped.

FIG. 7E illustrates timing at which the edge sensor 603 detects the fore end of the image G3. At the timing, the control unit 13 starts to count the conveyance amount before starting a detecting operation by the second cut mark sensor 602. This detecting operation is also one that is intended to detect the cut mark located downstream of the image G3, and for the same reason as that in case of the first cut mark sensor, the control unit 13 does not perform the detecting operation until the conveyance amount reaches the predetermined conveyance amount.

FIG. 7F illustrates the conveyance state at timing when the second cut mark sensor 602 starts the detecting operation. The detecting operation by the second cut mark sensor 602 is, as in the case of the first cut mark sensor 601, started when the non-image area W3 is located below the second cut mark sensor 602.

FIG. 7G illustrates timing at which the second cut mark sensor detects the cut mark in the non-image area W3 after the conveyance operation has proceeded.

FIG. 7H illustrates a situation where the second movable cutter 614 moves down toward the second fixed cutter 613 to cut the sheet at the boundary between the non-image area W3 and the image G3. Such a cutting operation is performed on the basis of the timing at which the second cut mark sensor 602 detects the cut mark in FIG. 7G. At the moment of the cutting operation, the conveyance operation is temporarily stopped.

The cutting between the non-image area W3 and the image G4 subsequent to the non-image area W3 in FIG. 7D, and the cutting between the non-image area W3 and the image G3 precedent to the non-image area W3 in FIG. 7G cause the non-image area W3 to be divided from the images G3 and G4 and contained in the trash box.

In the cutting process described above, a conveyance distance from FIGS. 7A to 7B, or a conveyance distance from FIGS. 7D to 7E include a certain level of error, and a value of the error increases as the conveyance distance, i.e., a length of the image G3 is increased. On the other hand, as in FIG. 7C or 7F, at the timing when the cut mark sensor starts the detecting operation, it is desirable that not the image area but the non-image area is surely located in a detecting area targeted by the cut mark sensor. That is, it is required to, during not the first surface printing but the second surface printing during which the cutting operation is actually performed, surely locate the non-image area in the detecting area at the timing when the cut mark sensor starts the detecting operation. In the present embodiment, even in the case of performing the first surface printing operation, on the basis of a length of not an image to be printed on the first surface but an image to be printed immediately before a non-image area on the second surface, a size of the non-image area is set.

Figure 8:
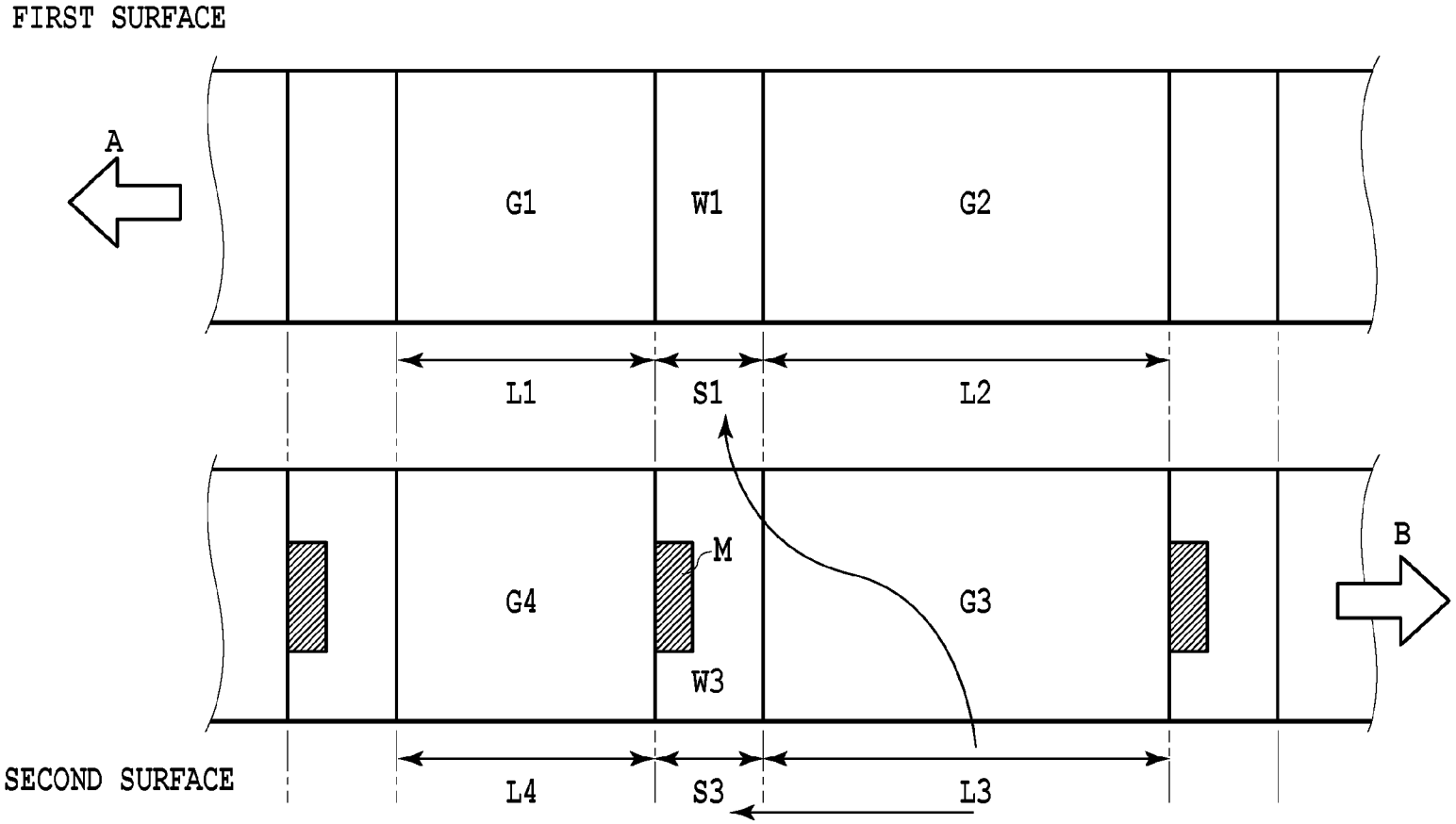
FIG. 8 is a diagram illustrating each of print states of first and second surfaces of a continuous sheet.

FIG. 8 is a diagram illustrating each of print states of the first and second surfaces of the above-described continuous sheet. Lengths of images G1, G2, and G3 are not uniform; however, on back surfaces of the images G1 and G2, the image G4 having almost the same size as that of the image G1 and the image G3 having almost the same size as that of the image G2 are respectively printed. Note that regarding the first surface, an A direction serves as the conveyance direction, and the images are printed in the order of G1→G2, whereas regarding the second surface, a B direction serves as the conveyance direction, and the images are printed in the order of G3→G4.

In the present embodiment, at the time of printing the first surface of the continuous sheet, the control unit 13 sets a length S1 of a non-image area W1 arranged between G1 and G2 on the basis of a length L3 of the image G3 printed on the back surface of G2. Further, the control unit 13 also sets a length S3 of the non-image area W3 arranged between G3 and G4 on the basis of the length L3 of the image G3. That is, S1 is equal to S3. In other words, in the direction in which the sheet is conveyed, as a length of an image printed precedently to a non-image area provided on the second surface increases, a length of the non-image area is increased. Conversely, as the length of the image printed precedently decreases, the length of the non-image area is also decreased. A relationship between the length of the precedent image and the length of the non-image area is not limited to a linear proportional relationship, but may be a stepwise proportional relationship.

Figure 9:
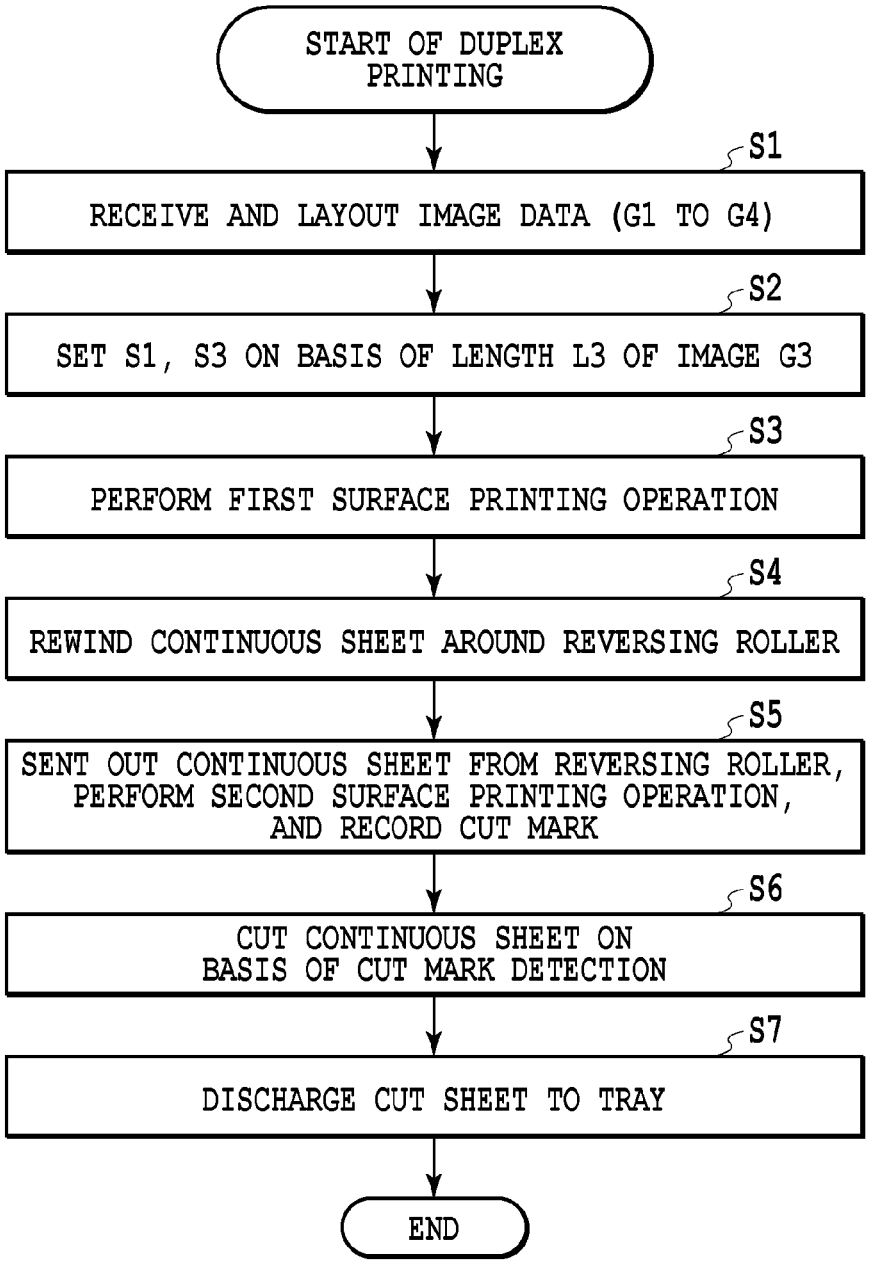
FIG. 9 is a flowchart for describing processing steps performed by the control unit at the time of duplex printing.
Figure 10:
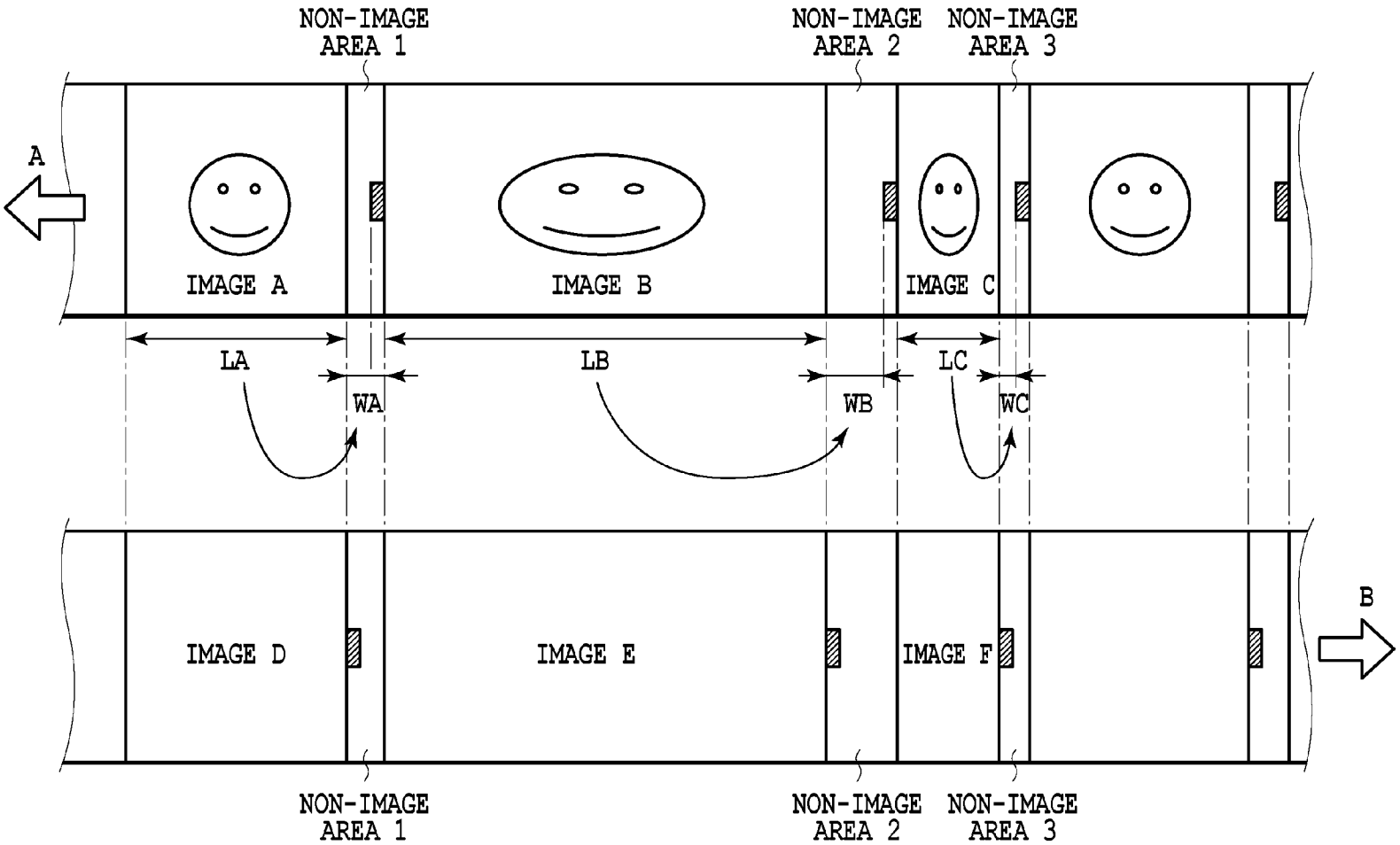
FIG. 10 is a schematic diagram for specifically describing a conveyance situation in Japanese Patent Laid-Open No. 2012-158122.

FIG. 9 is a flowchart for describing processing steps that are performed by the control unit 13 when a command for duplex printing is inputted. Here, the case of printing the images G1 to G4 on the front and back surfaces of the continuous sheet as in the state illustrated in FIG. 8 is taken as an example to provide the description.

When the series of processing steps is started, in Step S1, from the host device 16, the control unit 13 receives pieces of data on the images G1 to G4 to be printed. Then, the control unit 13 performs appropriate processing in the image processing part 207, and then determines layouts of the first and second surfaces as illustrated in FIG. 8.

In subsequent Step S2, on the length L3 of the image G3, the control unit 13 obtains the length S1 of the non-image area W1 on the first surface and the length S3 of the non-image area W3 on the second surface. As a method for obtaining these lengths, the lengths may be obtained by substituting L3 into a predetermined calculation formula, or by referring to a table that is preliminarily stored in the ROM 202 and relates image area lengths L and non-image area length S to each other.

In Step S3, the control unit 13 perform a first surface printing operation. That is, the control unit 13 uses the individual unit control part 209 to draw the continuous sheet from the sheet feeding unit 1, pass the continuous sheet through the decurling unit 2 and the skewing correcting unit 3, and in the printing unit 4, print the images G1 and G2 in this order. More specifically, after the image G1 has been printed with the print head 14, the non-image area W1 having the length S1 is provided, and then the image G2 is printed. Subsequently, in the cutter unit 6, a rear end part of the image G2 is cut off.

In Step S4, the control unit 13 rotates the reversing roller 9*a* clockwise in the diagram to rewind the continuous sheet printed with the images G1 and G2 around a surface of the reversing roller 9*a*. In doing so, part of the continuous sheet, which was fed from the sheet feeding unit 1 and is located on an upstream side of a cutting position, is wound back to the sheet feeding unit 1.

After the completion of the above winding back has been checked, in Step S5, the control unit 13 rotates the reversing roller 9*a* anticlockwise in the diagram to send the continuous sheet to the decurling part 2, and performs a second surface printing operation. That is, the control unit 13 uses the individual unit control part 209 to pass the continuous sheet through the decurling unit 2 and the skewing correcting unit 3, and in the printing unit 4, print the images G3 and G4 in this order. More specifically, after the image G3 has been printed with the print head 14, the non-image area W3 having the length S3 (≈S1) is provided, and the image G4 is printed. In addition, in the non-image area W3, the cut mark M is also printed.

In Step S6, the control unit 13 cuts the continuous sheets according to the processing steps illustrated in FIG. 7. This causes the continuous sheet to be cut into an image sheet of which front and back surfaces are printed with the images G1 and G4, the non-image area W1 (W3), and an image sheet of which front and back surfaces are printed with the images G2 and G3, and the non-image area to be contained in the trash box.

After that, in Step S7, the control unit 13 passes the image sheets respectively formed as cut sheets through the information printing unit 7, drying unit 8, and discharging/conveying unit 10, and discharges the image sheets to a tray 12 of the sorter unit 11. The processing steps are now completed.

As described above, in the case of performing duplex printing on first and second surfaces of a continuous sheet, in a direction in which the sheet is conveyed, depending on a length of an image to be printed precedently to a non-image area to be provided on the second surface, a length of the non-image area that is an area common in position and size to the first and second surfaces is set. This enables cut mark detection and cutting process having high reliability to be performed in second surface printing involving cutting operation because the non-image area of which the size depends on the size of the precedent image located on the upstream side in the conveyance direction is formed. In the case where the size of the precedent image is small, the non-image area is also formed small, and therefore a total amount of sheet pieces corresponding to non-image areas to be cut off and discarded can be reduced. That is, in the case of performing the duplex printing on the continuous sheet, by focusing on the image size not on the first surface but on the second surface to set the length of the non-mage area to an appropriate length, both of mark detection having high reliability and the suppression of a sheet consumption amount can be achieved.

Note that the above embodiment is described with use of a configuration in which on the basis of the one cut mark, the fore and rear end parts of the non-image area are cut respectively with the different cutter sets; however, exclusively for the respective cut mark sensors, cut marks may be prepared. Also, the cut mark may not be necessarily printed with the print head 14 of the printing unit 4. For example, the present invention may be configured to mark the cut mark by an exclusive mark forming unit different from the print head 14, or open a small hole in a sheet. In the latter case, at timing when irradiated light passes through the hole, a detected value of a light receiver is reduced, and thereby a position of the cut mark can be determined.

Also, in the above, the full line type printing apparatus of the inkjet system is taken as an example to provide the description; however, the present invention is not limited to such an embodiment. The printing apparatus may be a serial type one, and as a print system, various system such as an electrophotographic system, thermal transfer system, dot impact system, and liquid development system or the like can be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-085959, filed Apr. 16, 2013, which is hereby incorporated by reference herein in its entirety.

What is claimed is:

1. A printing method for performing duplex printing on a first surface and a second surface of a continuous sheet movable in a direction of sheet conveyance, comprising:

printing a plurality of images on the first surface of the continuous sheet with a non-image area between adjacent images;

printing a plurality of images on the second surface of the continuous sheet having been printed on the first surface with a same layout as the first surface, wherein a mark for cutting the sheet is printed in a space between each of adjacent images on the second surface;

prior to printing images on the first surface, analyzing data of the images to be printed on the second surface to obtain a length of each of the images in a direction of sheet conveyance; and setting a length of a target non-image area between two images in the direction of sheet conveyance on the first surface, depending on an obtained length of a precedent image to be printed immediately before a space between two images on the second surface which is a reverse part of the target non-image area.

2. The printing method according to claim 1, wherein:

the mark is intended to be detected by a sensor; and for detecting the mark with the sensor, depending on the obtained length of the precedent image, a position or timing to start the detection of the mark can be changed within the space.

3. The printing method according to claim 2, wherein a range where the mark is detected with the sensor is set together with the position or the timing to start the detection.

4. The printing method according to claim 1, wherein as the length of the precedent image increases, the length of the target non-image area is increased.

5. A printing apparatus comprising:

a printing unit configured to perform duplex printing on a first surface and a second surface of a continuous sheet under conveyance;

a detecting unit configured to detect a mark formed on the sheet;

a cutter unit configured to cut the sheet; and a control unit, wherein the control unit controls the printing unit such that while printing a plurality of images on the first surface and then on the second surface, a non-image area between each of adjacent images is provided on the first surface, and a mark to be detected in the detecting unit in order to cut the sheet by the cutter unit is printed in a space between each of adjacent images on the second surface, wherein the control unit causes the apparatus to analyze, prior to printing images on the first surface, data of each of the images to be printed on the second surface to obtain a length of each of the images in a direction of sheet conveyance, wherein the control unit sets a length of a target non-image area between two images in the direction of sheet conveyance on the first surface, depending on an obtained length of a precedent image to be printed immediately before a space between two images on the second surface which is a reverse part of the target non-image area, and wherein the control unit controls such that as the length of the precedent image increases, the length of the target non-image area increases.

6. The printing method according to claim 4, wherein printing is performed with a plurality of inkjet print heads for line printing.

7. The printing apparatus according to claim 5, wherein the printing unit includes a plurality of inkjet print heads for line printing.

* * * * *